US006665876B1

(12) United States Patent
Newman

(10) Patent No.: US 6,665,876 B1
(45) Date of Patent: Dec. 23, 2003

(54) COMBINATION PROTECTIVE SLEEVE AND HEAD WEAR

(76) Inventor: James O. Newman, 1844 S. Marengo Ave., #34, Alhambra, CA (US) 91803

( * ) Notice: Subject to any disclaimer, the term of this patent is extended or adjusted under 35 U.S.C. 154(b) by 0 days.

(21) Appl. No.: 10/003,977

(22) Filed: Nov. 1, 2001

(51) Int. Cl.[7] ..... A41D 27/12

(52) U.S. Cl. ..... 2/59; 2/207

(58) Field of Search ..... 2/16, 20, 22, 24, 2/59, 61, 91, 123, 124, 242, 125–126, 207, 208, 174, 202, 911, 917, 918, 60, 170, 268, 270; 602/3, 21, 61, 62, 63, 64; 36/1.5, 2 R; D2/610, 611, 623, 500, 860–862; D29/100, 120.1

(56) References Cited

U.S. PATENT DOCUMENTS

| | | | | | |
|---|---|---|---|---|---|
| 410,600 | A | * | 9/1889 | Mills | 66/172 R |
| 1,284,536 | A | * | 11/1918 | Yaeger | 2/59 |
| 2,125,451 | A | | 8/1938 | Kolliner | |
| 2,326,422 | A | | 8/1943 | Weisberger | |
| 3,036,450 | A | * | 5/1962 | Holder | 66/171 |
| 3,153,413 | A | | 10/1964 | Gottfried | |
| 3,322,118 | A | * | 5/1967 | Sotherlin | 128/892 |
| 3,657,741 | A | | 4/1972 | Blanco | |
| 4,382,301 | A | * | 5/1983 | Hightower, Jr. | 2/22 |
| D284,325 | S | | 6/1986 | Birmingham, Jr. et al. | |
| 4,706,304 | A | | 11/1987 | Jones | |
| 4,856,112 | A | * | 8/1989 | Effle | 2/59 |
| D313,674 | S | | 1/1991 | Sharpe | |
| 5,005,215 | A | | 4/1991 | McIlquham | |
| 5,139,187 | A | * | 8/1992 | Fowler | 224/576 |
| 5,642,525 | A | * | 7/1997 | Ketola | 2/16 |
| D393,138 | S | | 4/1998 | Frey | |
| 5,817,038 | A | * | 10/1998 | Orange et al. | 602/3 |
| D418,633 | S | | 1/2000 | Ruth | |
| D442,765 | S | | 5/2001 | Newman | |

OTHER PUBLICATIONS

"Tyvek Sleeve Protectors", Lab Safety Supply catalog, 1994, p. 131.

"Vinyl Waterproof Sleeves", Gempler's supply catalog, summer 1996, p. 14.

* cited by examiner

*Primary Examiner*—Tejash Patel
(74) *Attorney, Agent, or Firm*—Fulwider Patton Lee & Utecht, LLP

(57) ABSTRACT

A protective sleeve that can also be worn as head wear or around an athlete's neck for protection and comfort is generally comprised of a tubular body having a notched, cuffed opening at an upper end and a cuffed opening at an opposite lower end of the sleeve. At the sleeve's upper end, the cuff has two complementary radial cuff ties that generally extend from the opposite edges of the cuff adjacent the notch, while lengthwise cuff ties are provided in the inseams between the respective upper and lower cuffs and the sleeve body. A Velcro®-type closure system is provided at the upper cuff notch so as to close the notch and secure the sleeve in place on a wearer's arm. In some embodiments of the sleeve, one or more lengthwise mesh fabric strips are disposed in the tubular body along a lengthwise inseam. Preferably, the sleeve body, cuffs, and cuff ties are constructed of a lightweight, breathable and elastic synthetic material.

40 Claims, 3 Drawing Sheets

FIG. 1
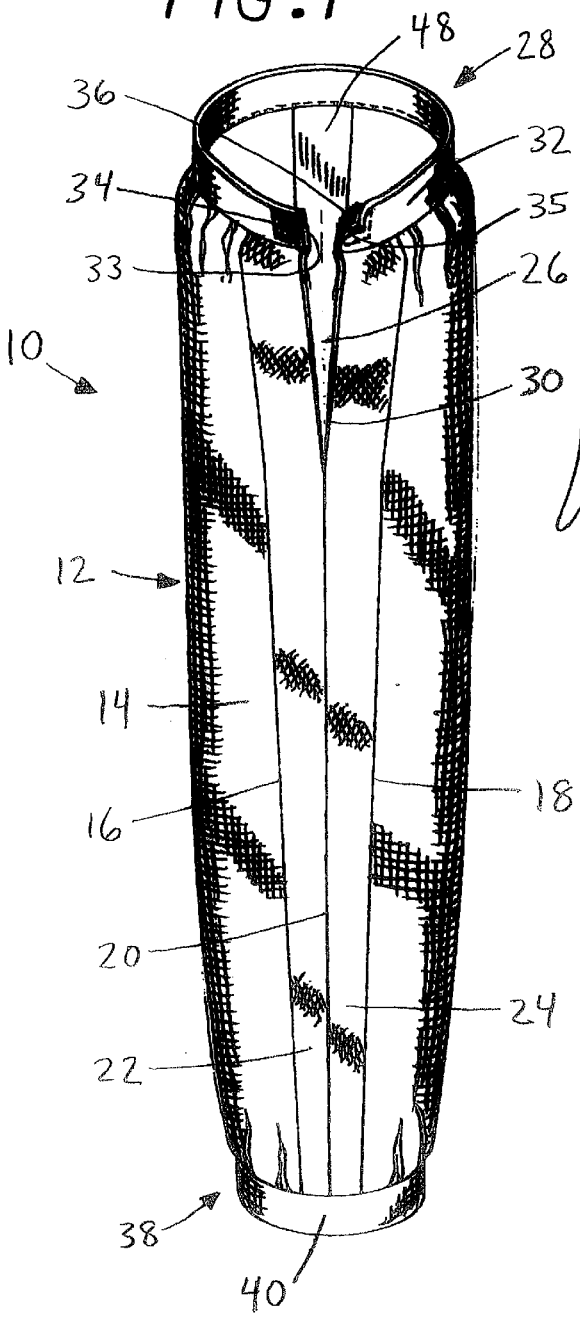
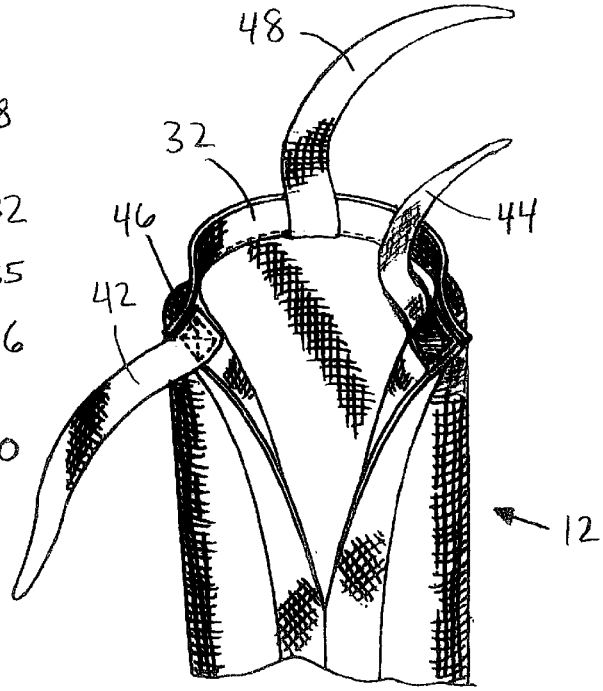
FIG. 2
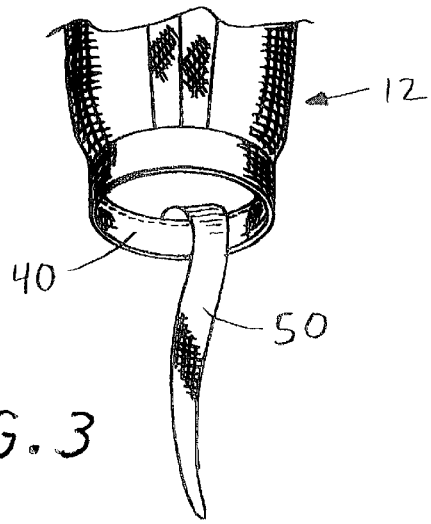
FIG. 3

FIG. 4
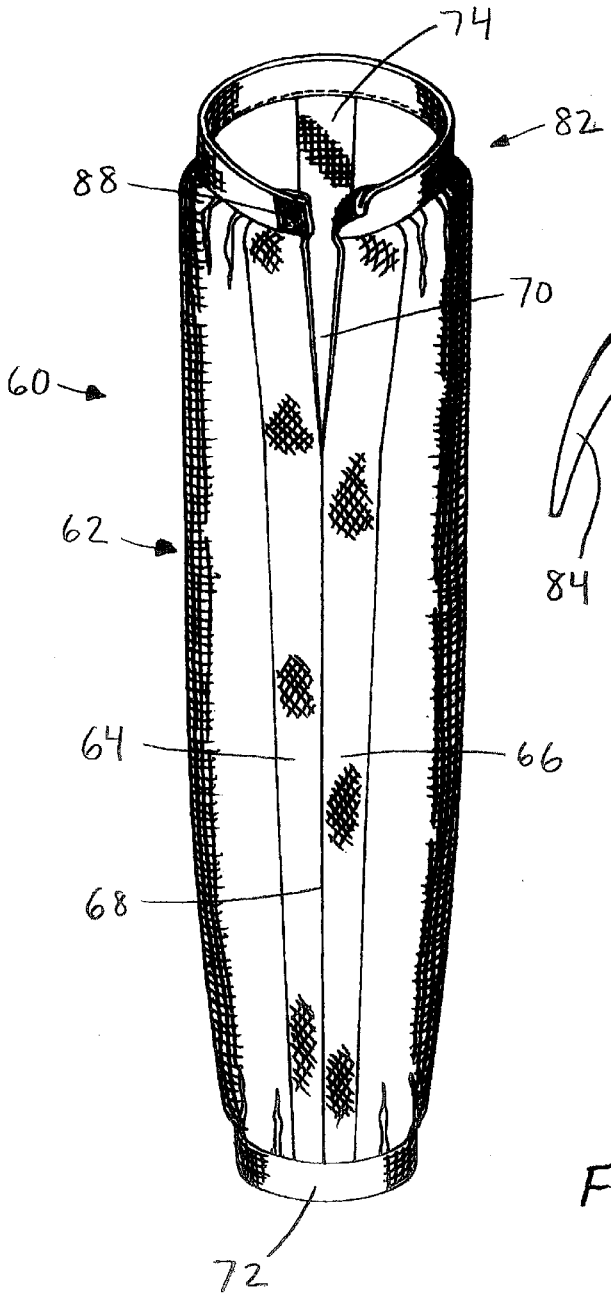
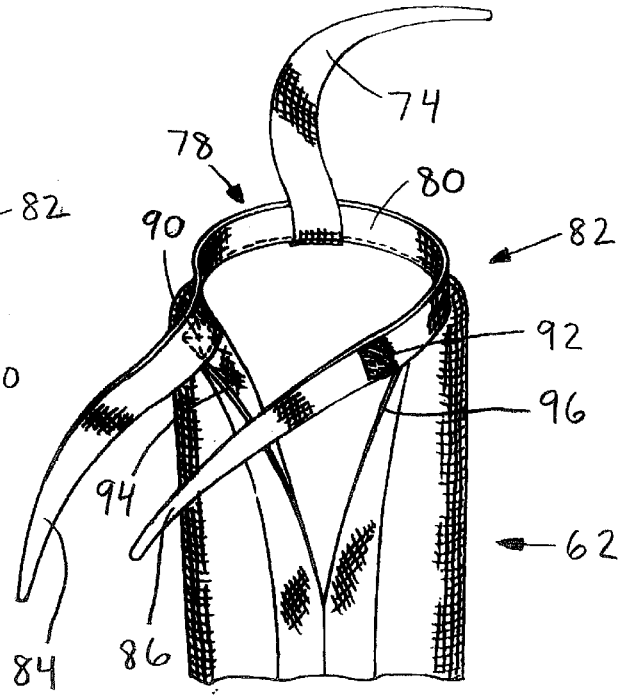
FIG. 5
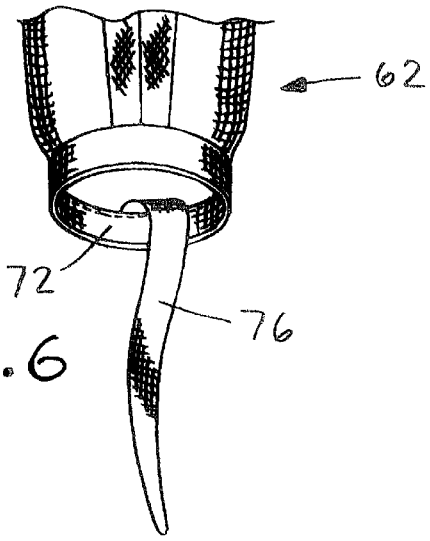
FIG. 6

COMBINATION PROTECTIVE SLEEVE AND HEAD WEAR

BACKGROUND OF THE INVENTION

1. Field of the Invention

The present invention relates to athletic apparel, and more particularly, to sleeves that can be worn by athletes or other individuals for added protection and comfort.

2. Description of the Prior Art

In the field of athletic apparel, the use of various types of clothing, pads, wraps, and head wear for protection, comfort, and warmth for an athlete engaged in a sport or other physical recreation are known in the art. A detachable or separate sleeve has long been recognized as an effective and efficient means for meeting an athlete's clothing needs during warm-up, actual competition, and rest periods between or after competing, without the athlete having to actually change clothing entirely when transitioning between these various periods of activity.

Some of the challenges faced by the various designs of detachable sleeves known in the art include functionality, style, and low cost. Typically, the more applications that a particular sleeve is designed to suit, the more likely it is that the sleeve does not suit any of the applications optimally. Particularly where both functionality and style are of concern, if both are to be met in a single design, it becomes all the more difficult for a single garment to fulfill with equal satisfaction, a variety of multiple uses. Thus, for many exacting athletes who demand the most from their athletic garments, clothing accessories are often required for each sport and for each level of performance that the athlete engages in. However, as such athletic apparel must generally incorporate higher quality, more durable materials and construction to hold up under the rigors of athletic activities, the cost of obtaining multiple garment accessories to optimally meet each of the athlete's intended uses becomes prohibitive. Such a need also exists in the non-athletic environment, wherein it is desirable for clothing accessories to perform multiple functions in order to meet several needs of the user.

Thus, there still exists a need for a multi-purpose detachable sleeve that is both stylish and well-suited to various uses and that can even be worn on more than one part of the body in order to meet very different needs for the user. The present invention is directed to just such a sleeve.

SUMMARY OF THE INVENTION

The present invention provides a protective sleeve that can also be worn as head wear or around an individual's neck for protection and comfort. The sleeve is generally comprised of a tubular body having a notched, cuffed opening at a first upper end and a continuous cuff about the opening at a second and opposite lower end of the sleeve. At the sleeve's upper end, the cuff has two complementary radial cuff ties that generally extend from the opposite edges of the cuff adjacent the notch. Lengthwise cuff ties are provided in the inseams between the respective upper and lower cuffs and the sleeve body and are configured to lay flush with the inner surface of the sleeve, but can be pulled out to project away from the sleeve if desired to use the garment as a head piece or scarf. A Velcro®-type closure system is provided at the upper cuff notch so as to close the notch and secure the sleeve in place on a wearer's arm. In alternate embodiments of the sleeve, one or more lengthwise mesh fabric strips are disposed within the tubular body along its lengthwise inseam. Preferably, the sleeve body, cuffs, and cuff ties are constructed of a lightweight, breathable, and elastic synthetic material such as spandex or LYCRA®.

In use, the protective sleeve is prepared to be worn on an individual's arm by laying the two lengthwise cuff ties flat against the inside surface of the sleeve, opening the notch at the upper cuff, and inwardly folding the complementary radial cuff ties so that all cuff ties are positioned within the sleeve. Next, the wearer pulls the sleeve over his or her arm and secures the upper cuff about his or her upper arm by simply attaching the velcro closure, while the lower cuff is elastically fitted about the user's wrist. Because the sleeve is constructed of a breathable synthetic fabric, it allows moisture to evaporate away while regulating body temperature, thereby keeping the wearer's arm dry and comfortable during various athletic or non-athletic activities. Additionally, the sleeve provides protection against the sun and ultraviolet rays thereby providing protection against sunburn and other forms of sun damage to the skin. Alternatively, the sleeve may be worn on the head in the same manner as one would wear a hat by opening the cuff and placing the upper end over the head. The sleeve may be retained on the wearer's head by tying the radial cuff ties under the wearer's chin or at the back of the head. Or, the sleeve may be draped or wrapped about the wearer's neck and secured using the lengthwise cuff ties. As worn on any such body part, the sleeve provides protection and comfort for the wearer. Moreover, since a single sleeve is capable of multiple uses, the sleeve meets a variety of needs for different levels and types of activity without the cost of purchasing a different garment or accessory for each such use.

Other features and advantages of the invention will become apparent from the following detailed description, taken in conjunction with the accompanying drawings, which illustrate, by way of example, the features of the invention.

BRIEF DESCRIPTION OF THE DRAWINGS

FIG. 1 is a perspective view of a protective sleeve embodying the present invention;

FIG. 2 is a partial perspective view of the upper end of the protective sleeve shown in FIG.

FIG. 3 is a partial perspective view of the lower end of the protective sleeve shown in FIG. 1;

FIG. 4 is a perspective view of an alternative embodiment of a protective sleeve embodying the present invention;

FIG. 5 is a partial perspective view of the upper end of the protective sleeve shown in FIG. 4;

FIG. 6 is a partial perspective view of the lower end of the protective sleeve shown in FIG. 4;

DETAILED DESCRIPTION OF THE PREFERRED EMBODIMENTS

Figure 7:
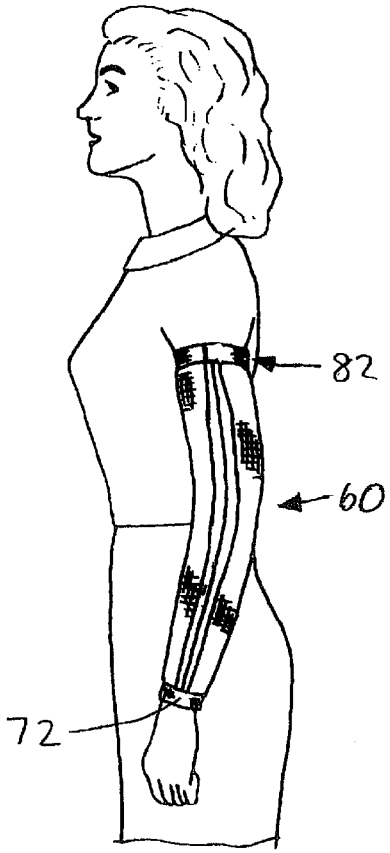
FIG. 7 is a partial left side view, in reduced scale, of a woman wearing the protective sleeve shown in FIG. 4 on her left arm.

As shown in the drawings for purpose of illustration, the present invention provides for an improved detachable sleeve that is capable of being worn both on the arm and on other body parts such as the head and neck. While the present invention is described and depicted in detail as a tubular sleeve of generally constant diameter and of a size to fit a typical adult woman, it will be appreciated by those skilled in the art that the invention can be used by males and children, as well as in conjunction with many other sleeves having shapes and configurations to suit a variety of functional uses, style preferences, and sizes.

Referring to FIG. 1, the present invention is generally directed to a detachable protective sleeve 10 having a generally elongated tubular body 12 made of any one of clothing fabrics known to those skilled in the art such as cotton, cotton blends, polyester material or, in a preferred embodiment, a somewhat elastic, breathable synthetic material such as LYCRA® or spandex and having a first, or upper, end 28 and a second, or lower, end 38. In the embodiment shown, the tubular body is essentially formed from a single substantially rectangular piece 14 of material that is joined together along its longer sides while being curved along its length to form a generally arcuate configuration. Because the piece is substantially rectangular, and thus has a generally constant width, when such piece of material is curved to form the tubular body as described above, the body has a substantially uniform cross-section and diameter. With this construction, it will be appreciated that the lengthwise edges 16 and 18 of the rectangular piece of material are generally parallel and can be aligned lengthwise and joined along the lengthwise edges, as by sewing them together, to form a lengthwise inseam in order to complete the tubular body. Alternatively, a zipper mechanism or snaps or Velcro® fastener means may be employed to join the two lengthwise edges 16 and 18 together.

In one embodiment of the present invention shown, two strips 22 and 24 of mesh fabric are sewn adjacent to each other along their respective inside edges on either side of the inseam 20 to form a strip portion wherein the first lengthwise strip 22 is joined with the lengthwise edge 16 of the rectangular piece 14 and a second lengthwise strip 24 is joined with the opposite lengthwise edge 18 of the rectangular piece. The mesh strips are constructed of an open-pored, highly-breathable fabric known in the art to provide ventilation and comfort for active athletes. Strips 22 and 24 are then joined together to form inseam 20. As shown, each of the strips is approximately one inch wide and spans the length of the tubular body 12. It will be appreciated that the strip width and the pore-size and spacing within the mesh fabric itself may be of any suitable configuration known in the art and effective for the particular use the protective sleeve is intended to serve. In the embodiment shown, both the pore size and the spacing between pores are approximately ⅛".

With continued reference to FIG. 1, a V-notch 26 is formed at the upper end 28 of the sleeve tubular body 12 approximately one-quarter of the way down the inseam 20 to allow the upper end to open wider than if the inseam was joined together along the body's entire length. V-notch 26 may be formed by the simple method of not joining edges 16 and 18 together along their entire length but rather leaving them separated a predetermined distance towards upper end 28 of the sleeve 10. The V-notch is reinforced with a ¼" topstitch 30 around its perimeter. A first, or upper, radial cuff 32 is sewn circumferentially about the upper end of the tubular body along an upper inseam such that a longitudinal discontinuity, or opening, in the upper cuff is aligned with the tubular body inseam V-notch 26 so as to further facilitate the providing of an enlarged opening at the upper end 28 of the sleeve. Along the opening in the upper cuff, adjacent and generally parallel lengthwise first and second edges 33 and 35 are thus formed.

Various closure devices known in the art may be configured on the upper cuff 32 to allow for selective closure of the V-notch 26 such as hooks, buttons or snaps. In the embodiment shown, a high-pile fabric swatch 34 is sewn on the outside surface of the upper cuff adjacent to the first edge 33 using a conventional cross-stitch 46 or other such stitch known in the art. Adjacent to the opposite second edge 35, but on the inside surface of the upper cuff, a mating hook or Velcro® swatch 36 is sewn, again using a stitch known in the art. In this way, the V-notch 26 may be detachably closed using a conventional velcro fastener system, as when the sleeve 10 is to be worn on the individual's arm. At the opposite lower end 38 of the sleeve tubular body 12, a continuous lower cuff 40 is sewn along a lower end of the sleeve. Because both the upper and lower cuffs are constructed of the same somewhat elastic, breathable synthetic material that the tubular body is made of, it will be appreciated that the lower cuff, though not slitted or notched, will be able to stretch sufficiently to pass over the wearer's hand and wrist as the sleeve is put on a wearer's arm. More will be said below about the sleeve in use.

Referring now to FIG. 2, the upper cuff 32 of the protective sleeve 10 of the present invention is configured with two radial cuff ties 42 and 44 that can be used in securing the sleeve onto the wearer's head, as a chin strap or the like. The first cuff tie 42 is sewn directly into the cross-stitch 46 on the inside surface of the upper cuff opposite the high-pile fabric swatch 34 adjacent the first edge 33. The complimentary second radial cuff tie 44 is sewn into the stitch that attaches the Velcro® swatch 36 and is there positioned such that it is secured between the Velcro® swatch and the inside surface of the upper cuff. The radial cuff ties are configured and attached thusly such that they are pointing in generally the same direction, so that when the sleeve is worn on the arm and the Velcro® closure is attached, both radial cuffties will naturally be positioned inside the sleeve, rather than outside, thereby being more functionally and aesthetically suitable.

Furthermore, with reference to FIGS. 2 and 3, lengthwise first and second, or upper and lower, cuff ties 48 and 50 are sewn into the inseams where the upper cuff 32 and lower cuff 40, respectively, are attached to the respective upper end 28 and lower end 38 of the sleeve tubular body 12 such that the ties natural tendency is to lay flush along the inside surface of the tubular body and point into, rather than out of, the sleeve 10, as best shown in FIG. 1 for the upper lengthwise cuff tie 48. The lengthwise cuff ties allow the detachable protective sleeve 10 of the present invention to be tied about the wearer's head or neck as a scarf or neck-warmer. All four cuff ties generally taper from a wide base at the respective seam to a narrow tip at the free end and are reinforced about their perimeters using an overlock stitch for optimal tying and untying of the ties while in use. Moreover, the four cuff ties are preferably made of the same material as the tubular cuff body.

As the protective sleeve 10 of the present invention is thus fully configured, the exemplary embodiment has an overall length of approximately 23 inches, wherein the tubular body 12 is approximately 19 inches and the upper and lower cuffs 32 and 40 are each approximately 2 inches wide. The overall diameter of the sleeve tubular body and the upper cuff is roughly 5 inches, while the diameter of the lower cuff is approximately 3 inches. It will be appreciated that because of the sleeve's relatively small size and the lightweight materials from which the sleeve is constructed, the sleeve may be comfortably worn on most any body appendage. Moreover, because the preferred material is a breathable material such as LYCRA® or spandex, the sleeve is capable of moving moisture from the wearer's skin to the fabric for more rapid evaporation and drying. Thus, the sleeve regulates moisture and body temperature to keep the wearer's arm dry and comfortable in all activities. The sleeve also provides protection to the wearer from exposure to the sun and ultraviolet radiation as well as protection from wind. Thus the sleeve can be worn during athletic endeavors to provide warmth and protection to the athlete and can also be worn by an individual engaged in normal activity simply desiring additional protection for the arms.

Referring now to FIGS. 4–6, an alternative embodiment of the protective sleeve of the present invention incorporates a variation on the radial cuff ties and Velcro® fastener system previously discussed. The alternative sleeve 60 is similarly constructed of a tubular body 62, lengthwise parallel mesh strips 64 and 66 about the lengthwise inseam 68, a V-notch 70, a continuous lower cuff 72, and lengthwise cuff ties 74 and 76 configured to point into the sleeve. However, in the alternative sleeve shown, the upper cuff and the radial cuff ties are not separate components, but one continuous strip of fabric.

With reference now to FIG. 5, an integral upper cuff 78 is formed from a single, continuous piece of elongated fabric material such that the central section 80 of the cuff has a generally constant width and a length substantially equivalent to the circumferential length about the upper end 82 of the sleeve tubular body 62. The opposite ends of the central section of the upper cuff 78 then terminate in respective tapered radial cuff ties 84 and 86 that point generally radially outwardly and can again be used when the sleeve is worn on the head to tie under the wearer's chin. On the outside surface of the upper cuff in the region where the central section transitions to the first cufftie 84 and generally proximally adjacent to a first edge 94 of the V-notch 70, a high-pile fabric swatch 88 is sewn, again using a conventional cross-stitch 90 or other stitch known in the art. On the outside surface of the upper cuff in the region where the central section transitions to the second cuff tie 86 and generally distally adjacent to the second edge 96 of the V-notch, a Velcro® swatch 92 as known in the art is sewn permanently in place.

With reference to FIG. 4, it will be appreciated that when the alternative embodiment protective sleeve 60 is placed onto a wearer's arm, the lengthwise cuff ties 74 and 76 naturally lay flush against the inside surface of the tubular body 62, while the radial cuff ties 84 and 86, because they are oriented generally radially outwardly, must be folded back on themselves and inwardly so as to generally point into the sleeve as it is put on the wearer's arm. It will be further appreciated that because the Velcro® swatch 92 is positioned on the outside of the upper cuff 78 distal of the second edge 96 of the V-notch 70, when the second radial cuff tie 86 is folded back on itself inwardly essentially about the second edge, the Velcro® swatch will then be oriented facing inwardly. Thus, the Velcro® swatch can detachably engage the high-pile fabric swatch 88 on the opposite first radial cuff tie 84 so as to effectively close the V-notch and secure the upper end 82 of the sleeve about the wearer's upper arm. As thus configured, all cuff ties are directed into the sleeve such that the sleeve is both aesthetic and functional when worn on the user's arm.

Figure 8:
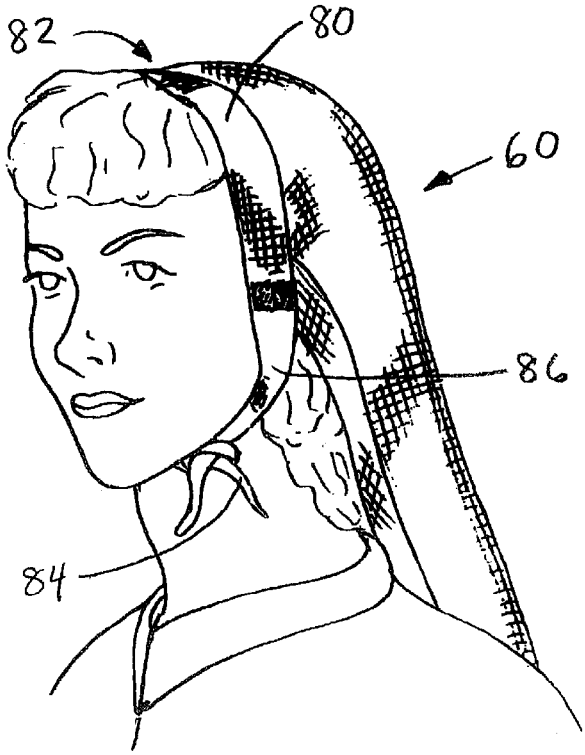
FIG. 8 is a partial perspective view, in reduced scale, of a woman wearing the protective sleeve shown in FIG. 4 on her head.
Figure 9:
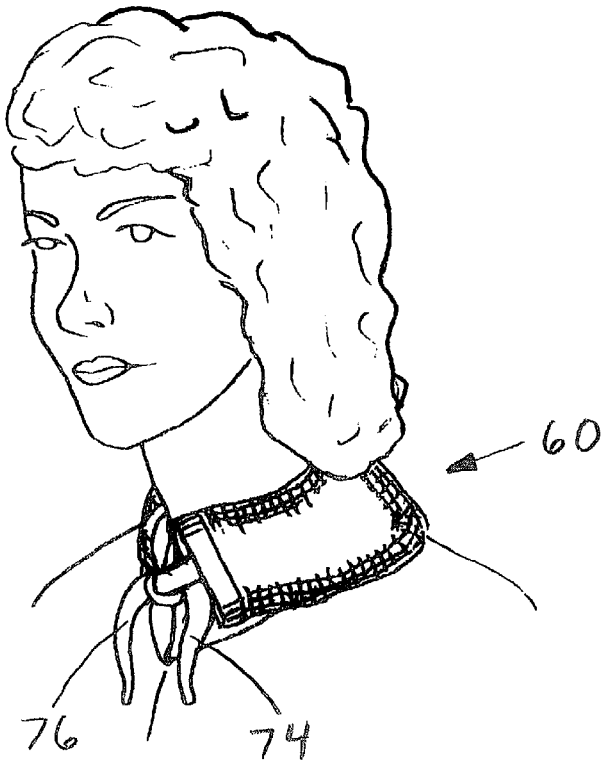
FIG. 9 is a partial perspective view, in reduced scale, of a woman wearing the protective sleeve shown in FIG. 4 around her neck.

Referring now to FIGS. 7–9, in use, the protective sleeve of the present invention is optimally configured to be worn both on an individual's arm and on other parts of the body such as the head and neck. With specific reference to FIG. 7, the alternative embodiment sleeve 60 having the integral upper cuff 78 may be worn on an individual's arm with the upper end 82 positioned about the biceps area of the arm just below the armpit and the lower cuff 72 positioned about the wrist. To secure the sleeve thusly, the sleeve is first prepared for placement on the arm by positioning the lengthwise cuff ties 74 and 76 such that they are laying flush along the inside surface of the tubular body 62 and generally pointed toward one another. Next, the radial cuff ties 84 and 86 are folded back on themselves inwardly so as to be pointed generally into the sleeve, with the Velcro® swatch 92 now facing inwardly but without yet being attached to the opposite high-pile fabric swatch 88 so that the V-notch 70 remains open. It will be appreciated that the LYCRA® or spandex material from which the sleeve is constructed is a low-pile fabric to which Velcro® does not readily attach, so that the V-notch will only close when the Velcro® and high-pile fabric swatches are brought into contact. With the sleeve thus configured, the individual inserts her hand into the upper end of the sleeve and begins to slide the sleeve up her arm using her free hand until the upper cuff is around her upper arm and the lower cuff is around her wrist. Then, using one or both hands, the Velcro® swatch and the high-pile fabric swatch are pulled toward one another and joined by simply pressing them together to detachably close the V-notch opening and secure the sleeve about the wearer's arm. To take the sleeve off, the Velcro® closure is pulled apart, and the sleeve is slid down the arm and off the hand.

It will be appreciated by those skilled in the art that the sleeve of the present invention can thus be taken on and off easily and conveniently as required based on the level and type of activity that the wearer is engaged in. Moreover, because of the upper cuff design and the simple operation of the Velcro® closure system, the wearer is able to take the sleeve on and off without any assistance from others. It will also be appreciated that the sleeve can be oriented in many ways on the individual's arm to best suit the need of the moment. For example, if optimal protection is required for the type of activity in which the individual is participating, the sleeve may be oriented such that the continuous tubular body is about the outer arm facing away from the wearer's torso, and particularly adjacent to and away from the elbow, with the mesh strips oriented along the inner arm facing toward the wearer's torso. Or, if protection is not necessarily critical and ventilation is most desired, the sleeve can be oriented about the individual's arm just the opposite, wherein the mesh strips would be positioned on the individual's outer arm facing away from the torso for maximum communication of air in and out of the sleeve through the openings in the mesh fabric, as shown in FIG. 7. It will also be appreciated that if the individual is interested in only keeping the biceps area warmed or protected or if the forearm area is best left uncovered, the lower cuff may simply be pushed up the arm until just above the elbow. The relatively thin, breathable and elastic fabric from which the sleeve is constructed will allow the lower cuff to stretch circumferentially over the elbow and be positioned about the larger part of the arm, while the entire sleeve will comfortably bunch up around the biceps area only.

Referring now to FIG. 8, the protective sleeve 60 of the present invention may also be worn about a person's head as a hat or bonnet. To wear the sleeve on the head in this manner, the individual would first prepare the sleeve as if it were going to be placed on the arm by laying the lengthwise cuff ties 74 and 76 flat on the inside surface of the tubular body 62 and opening the V-notch 70 as wide as possible. Only rather than folding the radial cuff ties inwardly, they are pulled radially outwardly. Next, the wearer would hold the sleeve by taking one radial cuff tie in each hand and then place the upper end 82 of the sleeve over the head such that the central section 80 of the upper cuff is generally centered across the top of the head and the V-notch is generally adjacent the back of the head near the base of the skull. Thus positioned on the head, the radial cuff ties will naturally hang down both sides of the head generally over the temples and in front of the ears. Then, the wearer would simply tie the two cuff ties under the chin to secure the sleeve on the head. Worn in this way, the lower end of the sleeve would cover the back of the neck and hang partway down the wearer's back. It will be appreciated by those skilled in the art that the sleeve may also be worn on the head in a number of other ways, including positioning the upper cuff about the wearer's head as a head band so that the central section is generally centered on the forehead and the V-notch and radial cuff ties are both positioned at the back of the head. As such, the sleeve is worn more as a Tam O'Shanter or similar style hat. By being worn on the head, it will be appreciated that the sleeve serves to keep the individual's hair and sweat out of her face and may also serve to keep the head warm if the individual is participating in a winter sport or in cold weather generally. Again, because the sleeve is made of a breathable fabric such as LYCRA® or spandex, it can serve as a regulator to keep the head at a comfortable temperature while allowing moisture to evaporate away.

Now with reference to FIG. 9, the protective sleeve of the present invention may also, among other things, be worn around the wearer's neck as a scarf or neck-warmer. To wear the sleeve in this manner, the wearer would fold the radial cuff ties 84 and 86 inwardly and close the V-notch 70 by pressing the fabric and Velcro® swatches 88 and 92 together. Next, the lengthwise cuff ties 74 and 76 would be pulled out of the tubular body 62 so that they are pointing away from one another and the sleeve itself. Then, the individual would simply drape the body of the sleeve about her neck and tie the lengthwise cuff ties loosely across her chest to hold the sleeve in place. In this way the sleeve serves to keep the neck cool and dry by wicking moisture away from the skin. Alternatively, the sleeve could be wrapped around the neck twice and then tied in place for a snugger fit, as when the individual is involved in cold-weather activities and warmth and dryness is most important.

Based on th e above, it will be appreciated that a wide variety of sleeve shapes and sizes can be employed with this invention to best suit the particular activities and the individual athlete who will be participating in those activities while still allowing the sleeve to serve its intended multiple purposes. Moreover, the sleeve can be constructed of fabrics of any color or aesthetic pattern to suit the various tastes and preferences of athletes and people in general and may even be customized after market, as for a sports team or the like, by having the team name and each player's respective number stitched, silk screened, or otherwise placed on the sleeve by a process known in the art.

Because individuals, and particularly athletes, often demand the best materials and construction for their garments, purchasing multiple garments and accessories for the athlete's various activities becomes prohibitive due to the increased cost associated with the higher quality garments. Therefore, it will also be appreciated that since a single sleeve according to the present invention is capable of multiple uses, the sleeve meets a variety of needs for different levels and types of activity without the cost of purchasing a different garment or accessory for each such use. For example, an athlete could wear the present invention sleeve on her pitching arm between innings in the early spring to keep her arm warm and on her head or neck while she snow skis in the winter for extra warmth and dryness. Thus, the same garment can affordably serve multiple and varied activities for the same athlete without any sacrifice of comfort, performance, or style.

Although the subject invention has been illustrated and described in the context of being worn by a female it is to be understood that the subject invention can be utilized by males. Similarly, the invention is not limited to use by adults but may also be utilized by children.

Various modifications and changes may be made with regard to the foregoing detailed description without departing from the spirit of the invention. Accordingly, the subject invention is not to be limited to the specific embodiments disclosed herein but is to be accorded the full scope and protection of the accompanying claims.

What is claimed is:

1. A combination protective sleeve and head wear, comprising:

a generally tubular body having an open first end and an open second end, wherein a V-notch is provided in said first end, said V-notch extending a predetermined distance along the length of said tubular body;

a first cuff affixed to said tubular body at said first end along a circumstantial first cuff inseam;

a second cuff affixed to said tubular body at said second end along a circumferential second cuff inseam;

a first lengthwise cuff tie affixed at said first end; and a second lengthwise cuff tie affixed at said second end.

2. The combination protective sleeve and head wear of claim 1, wherein said V-notch is reinforced with a topstitch.

3. The combination protective sleeve and head wear of claim 1, wherein said first cuff includes opposite first and second longitudinal edges to form a longitudinal opening there between corresponding to said V-notch.

4. The combination protective sleeve and head wear of claim 3, wherein said first cuff is formed with a closure means attached adjacent to said first and second longitudinal edges.

5. The combination protective sleeve and head wear of claim 4, wherein said closure means further comprises:

a high-pile fabric swatch attached to said first cuff adjacent to said first edge; and hook swatch attached to said first cuff adjacent to said second edge.

6. The combination protective sleeve and head wear of claim 3, further comprising:

a first radial cuff tie extending from said first longitudinal edge; and a second radial cuff tie extending from said second longitudinal edge.

7. The combination protective sleeve and head wear comprising:

a generally tubular body having an open first end and an open second end:

a first cuff affixed to said tubular body at said first end along a circumferential first cuff inseam;

a second cuff affixed to said tubular body a t said second end along a circumferential second cuff inseam, a first lengthwise cuff tie affixed at said first end; and a second lengthwise cuff tie affixed at said second end, wherein said first and second lengthwise cuff ties are tapered from a wider base at said first and second ends to a narrow free end opposite each said base.

8. The combination protective sleeve and head wear, comprising:

a generally tubular body having an open first end and an open second end;

a first cuff affixed to said tubular body at said first end along a circumferential first cuff inseam;

a second cuff affixed to said tubular body at said second end along a circumferential second cuff inseam;

a first lengthwise cuff tie affixed at said first end; and a second lengthwise cuff tie affixed at said second end, wherein said tubular body is comprised of a generally rectangular piece of material having respective first and second lengthwise edges, said piece of material being curved along its length to join that said first and second lengthwise edges along a lengthwise seam.

9. The combination protective sleeve and head wear, comprising:

a generally tubular body having an open first end and an open second end;

a first cuff affixed to said tubular body at said first end along circumferential first cuff inseam;

a second cuff affixed to said tubular body at said second along a circumferential second cuff inseam;

a first lengthwise cuff tie affixed at said first end; and a second lengthwise cuff tie affixed at said second end, wherein said tubular body is comprised of:

a generally rectangular piece of material having respective first and second lengthwise edges, said piece of material being curved along its length such that said first and second lengthwise edges are adjacent to form a lengthwise gap in said tubular body; and, a strip portion disposed in said gap.

10. The combination protective sleeve and head wear of claim 9, wherein said strip portion is comprised of:

a first lengthwise strip having a first outside edge and a first inside edge defining a first width;

a second lengthwise strip having a second outside edge and a second inside edge defining a second width; and a strip seam joining said first inside edge to said second inside edge.

11. The combination protective sleeve and head wear of claim 9, wherein said strip portion is formed from a breathable mesh fabric.

12. The combination protective sleeve and head wear of claim 10, wherein said first lengthwise strip and said second lengthwise strip are formed from a breathable mesh fabric.

13. The combination protective sleeve and head wear of claim 10, wherein said first width and said second width are substantially equal.

14. The combination protective sleeve and head wear of claim 10, wherein a V-notch is formed in said strip seam, said V-notch originating at said first end and extending a predetermined distance along said strip seam toward said second end.

15. The combination protective sleeve and head wear of claim 14, wherein said first cuff includes opposite first and second longitudinal edges to form a longitudinal opening there between corresponding to said V-notch.

16. The combination protective sleeve and head wear of claim 15, wherein:

a first radial cuff tie extends from said first longitudinal edge; and a second radial cuff tie extends from said second longitudinal edge.

17. A combination protective sleeve and head wear, comprising:

a tubular body having an open first end having a V-notch therein and an open second end;

a first cuff affixed to said tubular body at said first end along a circumferential first cuff inseam such that said first cuff has a longitudinal opening along its periphery having a first longitudinal edge and a second longitudinal edge;

a second cuff affixed to said tubular body at said second end along a circumferential second cuff inseam;

a first radial cuff tie extending from said first longitudinal edge; and a second radial cuff tie extending from said second longitudinal edge.

18. A combination protective sleeve and head wear, comprising:

a tubular body having an open first end and an open second end and a lengthwise tubular inseam there between;

a lengthwise opening along said lengthwise tubular inseam originating at said first end, said opening extending to an intermediate point along said tubular inseam to form a V-notch;

a first cuff affixed to said tubular body at said first end along a circumferential first cuff inseam such that said first cuff has a discontinuity corresponding to said V-notch;

a second cuff affixed to said tubular body at said second end along a circumferential second cuff inseam;

a first lengthwise cuff tie affixed at said first cuff inseam; and a second lengthwise cuff tie affixed at said second cuff inseam.

19. The combination protective sleeve and head wear of claim 18, further comprising a closure means affixed to said first cuff adjacent to said discontinuity for selectively closing said V-notch.

20. A combination protective sleeve and head wear, comprising:

a tubular body having an open first end and an open second end;

a breathable strip portion disposed within and extending the length of the wall of said tubular body;

a first cuff affixed to said tubular body at said first end along a circumferential first cuff inseam;

a second cuff affixed to said tubular body at said second end along a circumferential second cuff inseam;

a first lengthwise cuff tie affixed at said first cuff inseam; and a second lengthwise cuff tie affixed at said second cuff inseam.

21. A combination protective sleeve and head wear, comprising:

a tubular body having an open first end and an open second end;

a breathable strip portion disposed within and extending the length of the wall of said tubular body;

a V-notch formed in said first end of said tubular body;

a first cuff affixed to said tubular body at said first end along a circumferential first cuff inseam such that said first cuff has a discontinuity having a first discontinuity edge and a second discontinuity edge corresponding to the respective edges of said V-notch;

a closure means affixed to said first cuff adjacent to said first and second discontinuity edges for selectively closing said V-notch;

a first radial cuff tie and a second radial cuff tie extending toward one another from the respective said first and second discontinuity edges;

a second cuff affixed to said tubular body at said second end along a circumferential second cuff inseam;

a first lengthwise cuff tie affixed at said first cuff inseam; and a second lengthwise cuff tie affixed at said second cuff inseam.

22. The combination protective sleeve and head wear of claim 21, wherein said first and second radial cuff ties are integral with said first cuff.

23. The combination protective sleeve and head wear of claim 21, wherein said first and second radial cuff ties are separate from said first cuff and are attached along the respective said first and second discontinuity edges.

24. A combination protective sleeve and head wear, comprising:

a tubular body having an open first end and an open second end and a notch formed in said first end;

a breathable strip portion disposed within and extending the length of the wall of said tubular body;

a first cuff having a first cuff outside surface and a first cuff inside surface and affixed to said tubular body at said first end along a circumferential first cuff inseam such that said first cuff has a discontinuity corresponding to said notch having a first discontinuity edge and a second discontinuity edge opposite one another;

a first closure device affixed to said first cuff outside surface adjacent to said first discontinuity edge;

a second closure device affixed to said first cuff inside surface adjacent to said second discontinuity edge;

a first radial cuff tie affixed to said first cuff along said first discontinuity edge;

a second radial cuff tie affixed to said first cuff at said second closure device;

a second cuff affixed to said tubular body at said second end along a circumferential second cuff inseam;

a first lengthwise cuff tie affixed at said first cuff inseam; and a second lengthwise cuff tie affixed at said second cuff inseam.

25. A combination protective sleeve and head wear, comprising:

a generally tubular body having an open first end and an open second end, the first end being configured with a V-notch extending a predetermined distance along the length of said tubular body;

a first cuff affixed to said tubular body at said first end along a circumferential first cuff inseam;

a second cuff affixed to said tubular body at said second end along a circumferential second cuff inseam;

a first lengthwise cuff tie affixed at said first end; and a second lengthwise cuff tie affixed at said second end.

26. The combination protective sleeve and head wear of claim 25, wherein said V-notch is reinforced with a topstitch.

27. The combination protective sleeve and head wear of claim 25, wherein said first cuff includes opposite first and second longitudinal edges to form a longitudinal opening there between corresponding to said V-notch.

28. The combination protective sleeve and head wear of claim 27, wherein said first cuff is formed with a closure means attached adjacent to said first and second longitudinal edges.

29. The combination protective sleeve and head wear of claim 28, wherein said closure means further comprises:

a high-pile fabric swatch attached to said first cuff adjacent to said first edge; and a hook swatch attached to said first cuff adjacent to said second edge.

30. The combination protective sleeve and head wear of claim 27, further comprising:

a first radial cuff tie extending from said first longitudinal edge; and a second radial cuff tie extending from said second longitudinal edge.

31. The combination protective sleeve and head wear of claim 25, wherein said tubular body, said first cuff, said second cuff, said first lengthwise cuff tie, and said second lengthwise cuff tie are formed from a breathable, elastic material.

32. The combination protective sleeve and head wear of claim 31, wherein said material is a spandex fabric.

33. The combination protective sleeve and head wear of claim 25, wherein said first and second lengthwise cuff ties are tapered from a wider base at said first and second ends to a narrow free end opposite each said base.

34. The combination protective sleeve and head wear of claim 25, wherein said tubular body is comprised of a generally rectangular piece of material having respective first and second lengthwise edges, said piece of material being curved along its length to join said first and second lengthwise edges along a lengthwise seam.

35. The combination protective sleeve and head wear of claim 25, wherein said tubular body is comprised of:

a generally rectangular piece of material having respective first and second lengthwise edges, said piece of material being curved along its length such that said first and second lengthwise edges are adjacent to form a lengthwise gap in said tubular body; and a strip portion disposed in said gap, the strip portion being configured with a first lengthwise strip having a first outside edge and a first inside edge defining a first width, a second lengthwise strip having a second outside edge and a second inside edge defining a second width, and a strip seam joining said first inside edge to said second inside edge so as to configure said V-notch to originate at said first end and extend a predetermined distance along said strip seam toward said second end.

36. The combination protective sleeve and head wear of claim 35, wherein said first cuff includes opposite first and second longitudinal edges to form a longitudinal opening there between corresponding to said V-notch.

37. The combination protective sleeve and head wear of claim 36, wherein:

a first radial cuff tie extends from said first longitudinal edge; and a second radial cuff tie extends from said second longitudinal edge.

38. The combination protective sleeve and head wear of claim 35, wherein said strip portion is formed from a breathable mesh fabric.

39. The combination protective sleeve and head wear of claim 35, wherein said first lengthwise strip and said second lengthwise strip are formed from a breathable mesh fabric.

40. The combination protective sleeve and head wear of claim 35, wherein said first width and said second width are substantially equal.

* * * * *